United States Patent [19]

McMahon et al.

[11] Patent Number: 4,708,240

[45] Date of Patent: Nov. 24, 1987

[54] COMBINATION DISPLAY TRAY-CONNECTOR DEVICE

[75] Inventors: Paul J. McMahon, St. Charles; Heidi A. Sandusky, Chicago, both of Ill.

[73] Assignee: Container Corporation of America, Chicago, Ill.

[21] Appl. No.: 945,022

[22] Filed: Dec. 22, 1986

[51] Int. Cl.[4] ..... B65D 5/50

[52] U.S. Cl. ..... 206/45.18; 206/45.25; 206/821; 206/501

[58] Field of Search ..... 206/45, 45.25, 45.18, 206/821, 501

[56] References Cited

U.S. PATENT DOCUMENTS

| | | | |
|---|---|---|---|
| 1,380,561 | 6/1921 | Kaufmann | 206/45.25 |
| 1,600,049 | 9/1926 | Keppler | 206/45.25 |
| 1,667,376 | 4/1928 | Fehrenkamp | 206/45.25 |
| 1,701,157 | 2/1929 | Hoge | 206/45.25 |
| 2,312,595 | 3/1943 | Smith | 206/45.25 |

*Primary Examiner*—Joseph Man-Fu Moy

*Attorney, Agent, or Firm*—Richard W. Carpenter

[57] ABSTRACT

A one piece, paperboard, combination display tray-connector device having upwardly extending front and side walls and downwardly extending rear and side walls and being adapted to be used alone on a counter as display tray, for holding articles, or as a connector for interconnecting other containers or similar devices in a vertically stacked display arrangement.

6 Claims, 7 Drawing Figures

COMBINATION DISPLAY TRAY-CONNECTOR DEVICE

BACKGROUND OF THE INVENTION

1. Field of the Invention

This invention relates generally to display containers, and and more particularly to a one-piece combination display tray-connector device adapted to be used individually on a counter as a display tray, for holding and displaying articles of merchandise, or as a connector for interconnecting other containers or similar devices in a vertically stacked arrangement to provide a floor display.

2. Description of the Prior Art

A prior art search directed to the subject matter of this application in the United States Patent and Trademark Office disclosed the following U.S. Pat. Nos.: 1,582,355; 2,107,991; 2,283,890; 2,659,483; 2,804,199; 2,823,794; 4,582,283.

None of the prior art patents uncovered in the search discloses a one-piece display tray-connector device with upper front and side walls and lower rear and side walls adapted to maintain the device in a sloping position for display purposes.

SUMMARY OF THE INVENTION

It is an object of the present invention to provide a one piece display tray-connector device formed of foldable sheet material, such as paperboard, which can be used by itself on a counter as a display tray or stacked with other containers and/or devices to provide a floor display.

A more specific object of the invention is the provision in a display tray-connector device of the type described, of a structure having upwardly extending front and side walls and downwardly extending rear and side walls adapted to maintain the device in a forwardly sloping condition to facilitate display of articles held therein.

These and other objects of the invention will be apparent from an examination of the following description and drawings.

It will be understood that, for purposes of clarity, certain elements may have been intentionally omitted from certain views where they are believed to be illustrated to better advantage in other views.

DESCRIPTION OF THE PREFERRED EMBODIMENT

Figure 1:
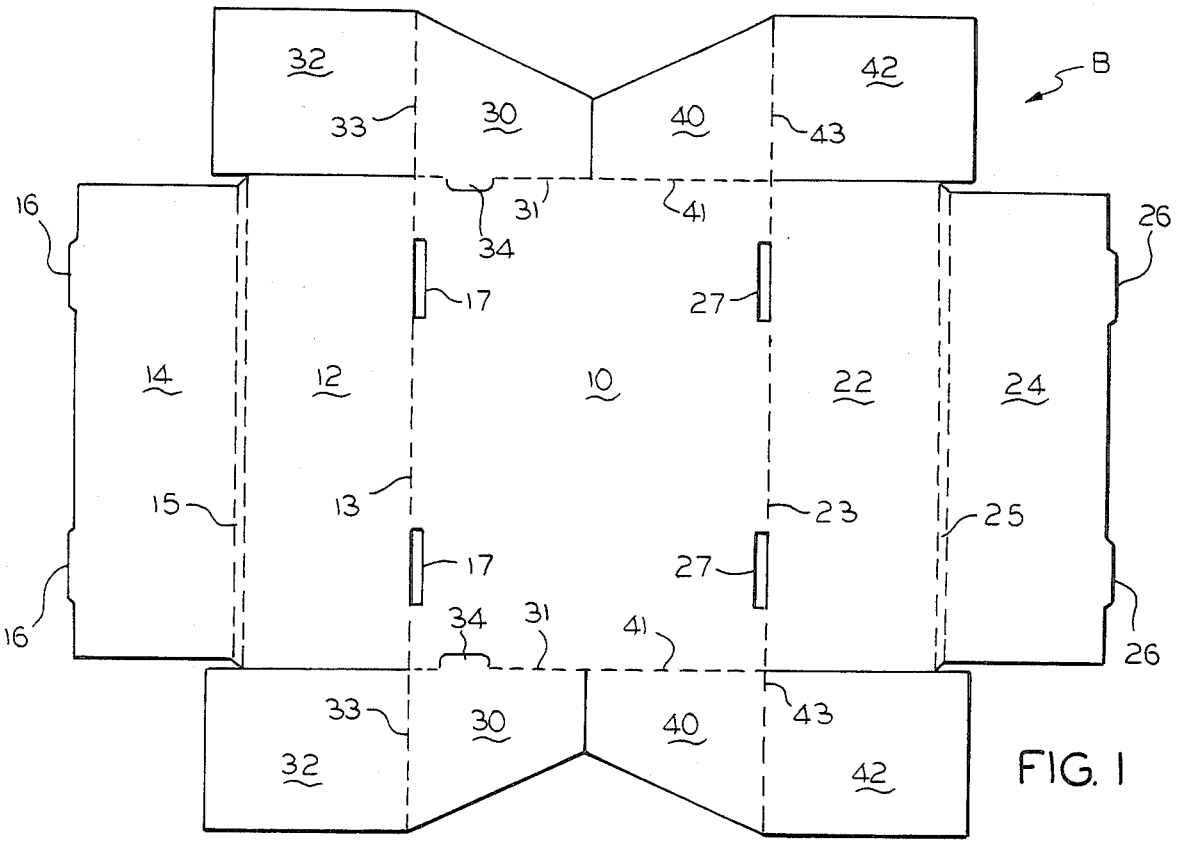
FIG. 1 is a plan view of a blank of foldable sheet material from which the display tray-connector device of the invention illustrated in the other views may be formed.
Figure 3:
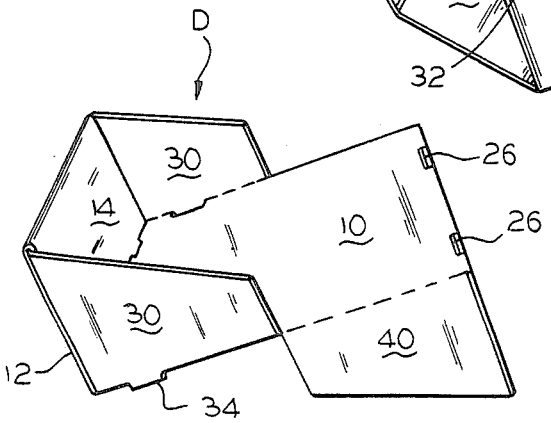
FIG. 3 is a perspective view of the tray-connector device shown in a fully erected condition.
Figure 4:
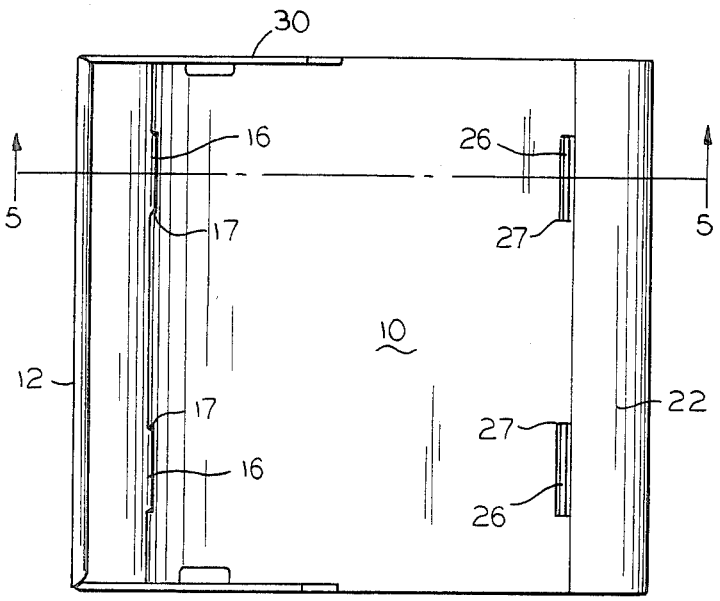
FIG. 4 is a top plan view of the structure of FIG. 3.

Referring now to the drawings for a better understanding of the invention, it will be seen that the novel display tray-connector device, indicated generally at D and illustrated in FIG. 3, may be formed from a unitary blank B of foldable sheet material illustrated in FIG. 1 of the drawings.

Figure 2:
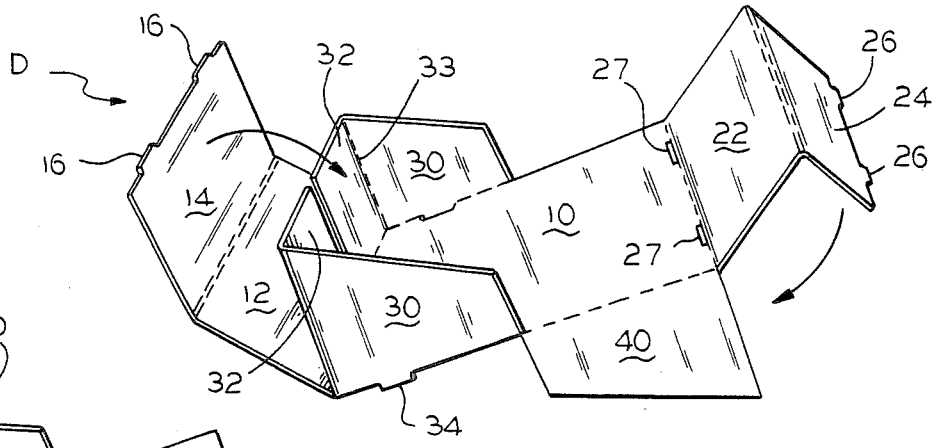
FIG. 2 is a fragmentary perspective view illustrating one step in the formation of the erected tray-connector device from the blank of FIG. 1.

The tray-connector, as best seen in FIGS. 1 and 2, includes a preferably generally rectangular bottom wall panel 10 which is disposed to slope downwardly and forwardly to facilitate displaying articles of merchandise. The sloping is accomplished by means of the lower end and side walls as described later in the specification.

Extending upwardly from the forward edge of bottom wall panel 10 is an upper front wall which includes an outer panel 12, foldably joined to the forward edge of bottom wall panel 10 on a fold line 13, and an inner panel 14 foldably joined to the upper edge of outer panel 12 along a preferably double fold line 15 and folded inwardly and downwardly at a 180 degree angle so as to lie against the inner surface of outer panel 12.

At its lower edge, inner panel 14 may be provided with a pair of "Walker Lock" type tabs 16 adapted to be received within complementary slots 17 formed in bottom wall panel 10 adjacent fold line 13.

A pair of trapezoidal shaped upper side wall panels 30 are foldably joined to opposite side edges of bottom wall panel 10 along fold lines 31. Each of the upper side wall panels 30 has a width which is approximately one half of the distance from front to rear of bottom wall panel 10. Panels 30 are disposed to extend upwardly from bottom wall panel 10 at the front end thereof and each has foldably joined thereto, on a fold line 33, an end wall intermediate or locking panel 32. Locking panels 32 are disposed to be folded inwardly at right angles to upper side wall panels 30 and are interposed between the outer and inner panels 12 and 14, respectively, of the upper end wall to provide a rigid corner construction for the container.

At the rear of the device there is provided a structure similar to that at the front end of the device, but which extends downwardly rather than upwardly. This structure includes a rear wall having an outer panel 22 extending downwardly from a rear edge of bottom wall panel 10 and foldably joined thereto along a fold line 23. The lower rear wall also includes an inner panel 24 foldably joined along preferably double fold line 25 to the lower edge of outer panel 22 and disposed to extend upwardly therefrom in face to face relation with the inner surface of panel 22. Inner panel 24 is also provided with a pair of "Walker Lock" type locking tabs 26 adapted to fit within related slots 27 formed in bottom wall panel 10 adjacent fold line 23.

Extending downwardly from rear portions of the side edges of the bottom wall panel 10 are a pair of trapezoidal shaped lower side wall panels 40 which are foldably joined at their upper edges along fold lines 41 to opposite side edges of bottom wall panel 10. Fold lines 41 are extensions of respective fold lines 31.

A pair of rear wall intermediate or locking panels 42 are foldably joined along fold lines 43 to rear edges of the respective lower side wall panels 40 and are disposed to be folded inwardly at right angles thereto and interposed between the outer and inner panels 22 and 24 of the lower rear wall to again form a rigid corner construction on the underside of the container.

Thus, it will be understood that the lower rear and side walls, which extend downwardly from the bottom wall panel 10, serve as a base or supporting structure to maintain the bottom wall panel 10 at an angle so that it slopes downwardly and forwardly toward the front of the container. The device may be used as a display tray standing alone on a counter, either holding articles or holding another container C which is filled with articles of merchandise to be displayed.

Figure 7:
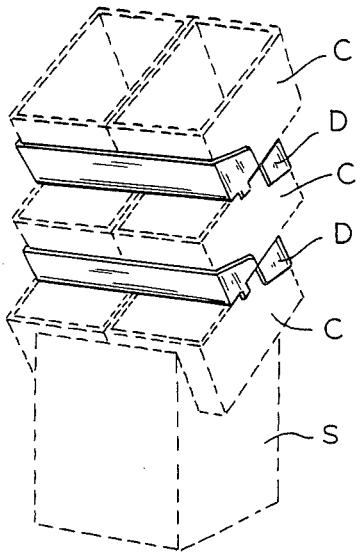
FIG. 7 is a view similar to FIG. 6 but illustrating the device shown supported by a base and stacked with other containers and devices to provide a floor display.
Figure 5:
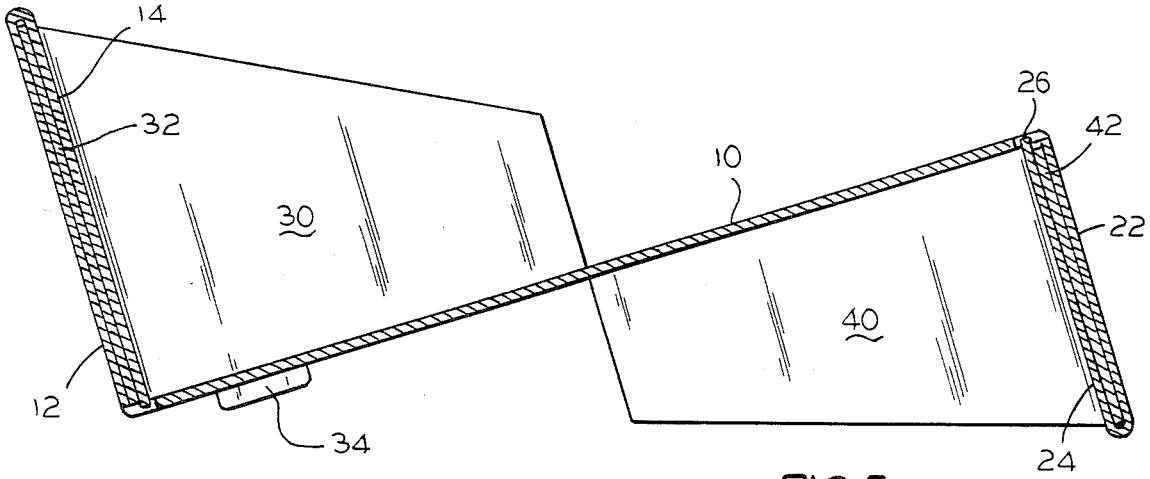
FIG. 5 is a transverse vertical sectional view taken on line 5—5 of FIG. 4.
Figure 6:
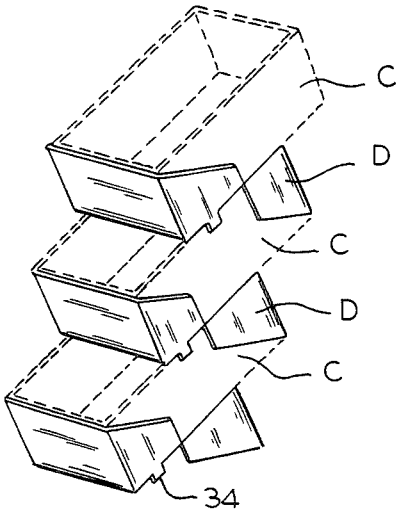
FIG. 6 is a perspective view illustrating the manner in which the device can be interconnected with other containers held by similar devices to provide a counter display.

Also, the device may be used in a floor display as shown in FIG. 7, where it is supported by a base S and is stacked with other containers C and similar devices D.

In order to facilitate stacking with other devices or containers, upper side wall panels 30 may be provided at their lower edges with downwardly projecting stacking tabs 34 adapted for interlocking engagement with upper edges of another container, as illustrated in FIG. 7, to maintain the containers properly aligned when stacked together.

Thus, it will be appreciated that the invention provides a relatively simple but strong display device of rigid construction which can be inexpensively formed from a unitary blank of foldable sheet material and can be used individually or stacked with other devices D or containers C.

What is claimed is:

1. A combination display tray-connector device that can be used alone as a display tray, for holding one or more articles to be displayed, or as a connector device, for interconnecting and supporting other containers or similar devices in a vertically stacked arrangement, said device being formed from a unitary blank of foldable sheet material, such as paperboard, and not requiring outside fastening means, said container comprising:

(a) a generally rectangular bottom wall panel disposed to slope downwardly and forwardly;

(b) an upper front wall extending upwardly from a front edge of said bottom wall panel;

(c) a pair of upper side wall panels extending upwardly from opposite side edges of said bottom wall panel and rearwardly from respective side edges of said upper front wall;

(d) a lower rear wall extending downwardly from a rear edge of said bottom wall panel;

(e) a pair of lower side wall panels extending downwardly from opposite side edges of said bottom wall panel and forwardly from respective side edges of said rear wall;

(f) said lower side wall panels each having a lower edge which forms an acute angle with said lower rear wall, so that said lower rear wall and side wall panels will maintain said device in a downwardly and forwardly sloping position;

(g) said container including, integral downwardly projecting tab means to facilitate interlocking engagement with another container or similiar device for stacking thereon.

2. A device according to claim 1 wherein said device is symmetrical so that it can be used in more than one position.

3. A device according to claim 1, wherein said front walls each include a pair of inner and outer panels foldably joined to each other.

4. A device according to claim 3, and including locking panels foldably joined to corresponding edges of said side wall panels with the locking panels at each end of the device being folded inwardly and interposed between respective end wall inner and outer panels.

5. A device according to claim 3, wherein each of said end wall inner panels has projecting from the free end thereof at least one lock tab adapted to be received within a complementary opening in said bottom wall panel.

6. A unitary blank of foldable sheet material, such as paperboard, for forming a combination display tray-connector device that can be used alone as a display tray, for holding one or more articles to be displayed, or as a connector for interconnecting and supporting other containers or similar devices in a vertically stacked arrangement, said blank comprising:

(a) a generally rectangular bottom wall panel;

(b) an upper front wall outer panel foldably joined to a front edge of said bottom wall panel;

(c) an upper front wall inner panel foldably joined to a front edge of said upper front wall outer panel;

(d) a pair of upper side wall panels foldably joined to opposite side edges of said bottom wall panel immediately rearwardly of said upper front wall outer panel;

(e) a lower rear wall outer panel foldably joined to a rear edge of said bottom wall panel;

(f) a lower rear wall inner panel foldably joined to a rear edge of said lower rear wall outer panel;

(g) a pair of lower side wall panels foldably joined to opposite side edges of said bottom wall panel immediately forwardly of said lower rear wall outer panel;

(h) pairs of front and rear wall locking panels foldably joined to front and rear edges of said upper and lower side wall panels, respectively, and disposed outwardly adjacent related upper and lower end wall inner panels, respectively.

* * * * *